United States Patent [19]

Van Roeyen

[11] 4,397,325

[45] Aug. 9, 1983

[54] ABRASIVE ARTICLE

[75] Inventor: Harry P. Van Roeyen, Skokie, Ill.

[73] Assignee: Barristo, Ltd., Chicago, Ill.

[21] Appl. No.: 375,454

[22] Filed: May 6, 1982

Related U.S. Application Data

[62] Division of Ser. No. 177,456, Aug. 12, 1980, Pat. No. 4,369,099.

[51] Int. Cl.[3] ..... A45D 29/04

[52] U.S. Cl. ..... 132/76.4; 132/75.6

[58] Field of Search ..... 132/76.4, 73, 75.6

[56] References Cited

U.S. PATENT DOCUMENTS

| | | | |
|---|---|---|---|
| 1,955,572 | 4/1934 | Adler | 427/203 |
| 2,308,624 | 1/1943 | Pouech | 132/76.4 |
| 2,694,647 | 11/1954 | Cole | 427/191 |
| 2,699,791 | 1/1955 | Hansen | 132/76.4 |
| 2,820,746 | 1/1958 | Keeleric | 204/16 |
| 2,858,256 | 10/1958 | Fahnoe | 204/4 |
| 3,023,490 | 3/1962 | Dawson | 29/194 |
| 3,061,525 | 10/1962 | Grazen | 204/9 |
| 3,318,318 | 5/1967 | Gewirz | 132/76.4 |
| 3,377,264 | 4/1968 | Duke | 204/290 R |
| 4,154,276 | 5/1979 | Wesner | 427/203 |

*Primary Examiner*—Gregory E. McNeill

*Attorney, Agent, or Firm*—Hill, Van Santen, Steadman, Chiara & Simpson

[57] ABSTRACT

Nail files and other abrasive articles have a structural base, such as a steel strip, coated with a slurry of a resin, such as an epoxide, and abrasive particles or grits, such as aluminum oxide, granules with sharp peaks and corners, of selected size and covered with one or more layers of electroplated metal, such as copper, nickel and chromium, forming a sheath surrounding the coated base and firmly anchoring the particles around the base. The electroplated metal has relatively thick valley portions covering the bases of the particles but only has relatively thin films over the peaks of the particles. In use, the thin coatings over the peaks of the particles are broken off, exposing the tip ends of the abrasive particles for effective abrasion of surfaces, such as fingernails, rubbed thereover. The thermosetting resin material provides the initial positioning and preliminary anchoring of the abrasive particles on the base, but the sheath of electroplated metals overlying the resin coating provides the permanent anchor for the particles. The particle sizes of the abrasive granules can be controlled so that opposite faces of the file or different portions of the same face can have regulated fine or coarse abrading action.

20 Claims, 7 Drawing Figures

ABRASIVE ARTICLE

RELATED APPLICATION

This application is a division of the Harry P. Van Roeyen U.S. patent application, Ser. No. 177,456, filed Aug. 12, 1980 now U.S. Pat. No. 4,369,098, issued Jan. 18, 1983 entitled "METHOD OF MANUFACTURING ABRASIVE ARTICLES".

BACKGROUND OF THE INVENTION

1. Field of the Invention

This invention relates to the art of abrasive devices having sharp abrasive particles anchored on a structural base, such as a metal strip. Specifically, the invention deals with metal fingernail files with aluminum oxide sharp pointed granules or grits of selected size coated on a steel strip in an epoxy resin base with one or more electroplated metal layers covering the base and forming a sheath around the metal strip firmly anchoring the particles but being sufficiently frangible over the peaks of the particles to break off during use and expose the particles.

2. Prior Art

Armored metal tools having abrasive particles anchored in metal coatings on metal bases through fusion bonds are known in the art as, for example, in the Dawson U.S. Pat. No. 3,023,490. Use of adhesives to bind refractory particles to a base metal prior to fusion bonding the particles to the base at high temperatures is disclosed, for example, in the Cole U.S. Pat. No. 2,694,647. Deposition of abrasive particles on metal bases by electrolplating the base through the pores is known, for example, in the Fahnoe et al U.S. Pat. No. 2,858,256. Simultaneous electrodeposition of a metal from a liquid electrolyte and settling of particles through the liquid onto a cathode is known from the Grazen U.S. Pat. No. 2,694,647, for example. These prior methods, however, are expensive and require high temperature fusion bonding or actual plating of the base. The electrophoretic deposition procedures require formation of porous coatings and deposition of the electrolplate through the pores onto the underlying bare metal. The present invention now utilizes a resin coating to initially deposit the abrasive particle on the metal base and then uses electroplating procedures to form a plated metal sheath or shell around the base which will firmly anchor the particles preventing them from being pulled out and yet being thin and frangible enough to break off at the discrete peaks of the particles for exposing them to the surface to be abraded.

SUMMARY OF THE INVENTION

According to this invention, fingernail files and other abrasive devices are easily and inexpensively formed by coating a structural base, such as, for example, a mild steel stamped strip with a slurry composed of abrasive granules, preferably aluminum oxide, and a resin carrier, preferably an epoxide thermosetting resin material, followed by electrodeposition of one or more layers of metal such as copper, nickel, and chromium to form a sheath or shell around the coated base, which is very thin at the projecting peaks of the granules, but relatively thick in the valleys between the peaks so that the thin portions can break off during use to expose the sharp points of the granules while the thick portion will firmly retain the granules in fixed locked position. The slurry has a relatively high concentration of the abrasive granules so that the resin coating on the base will have a myriad of granule peaks and points projecting therefrom to receive the electroplate thereover. The plated metal is relatively thin so that the higher peaks of the granules may remain exposed or only covered with a thin frangible plating that breaks off in use of the devices.

It is then an object of this invention to provide devices for abrading with sharp abrasive granules anchored in a shell surrounding a structural base and connected to the base by a resin.

A further object of this invention is to provide friction surface articles composed of a plurality of sheaths or coatings around a base anchoring friction producing abrasive particles with peaks adapted to project from the outermost sheaths.

A still further object of this invention is to provide a nail file with sharp pointed abrasive particles or granules firmly anchored in an electroplated sheath surrounding the structural base and attached to the base by a thermoplastic resin coating.

Other and further objects of this invention will become apparent to those skilled in this art from the attached drawings and written description thereof illustrating a preferred embodiment of the invention.

ON THE DRAWINGS

AS SHOWN IN THE DRAWINGS

Figure 1:
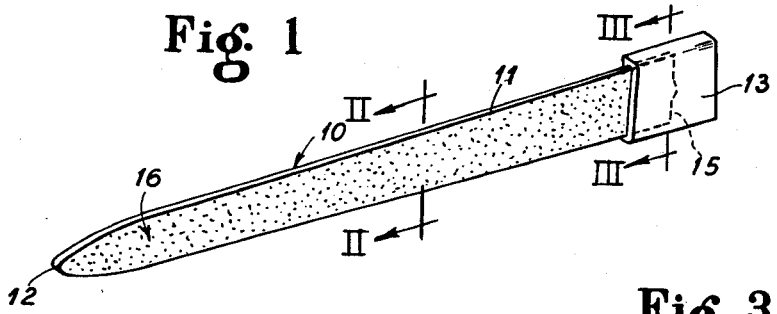
FIG. 1 is a perspective view of a fingernail file according to this invention.
Figure 2:
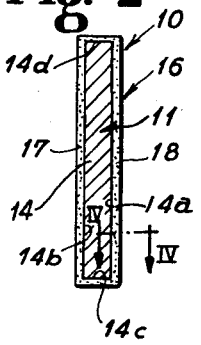
FIG. 2 is an enlarged transverse cross-sectional view taken along the line II—II of FIG. 1.
Figure 3:
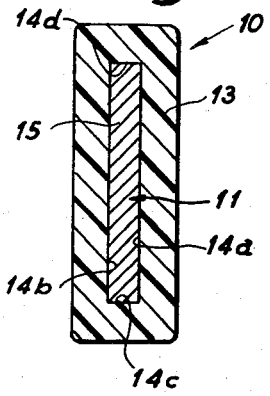
FIG. 3 is a transverse cross-sectional view taken along the line III—III of FIG. 1.
Figure 4:
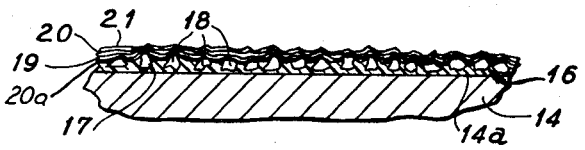
FIG. 4 is a very enlarged fragmentary cross-sectional view aong the line IV—IV of FIG. 2.
Figure 5:
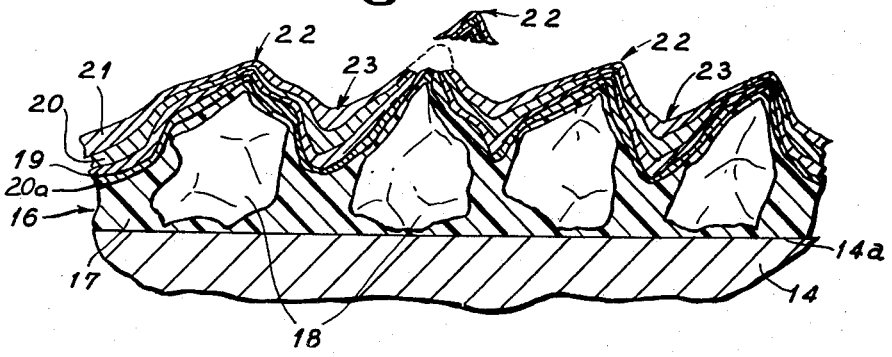
FIG. 5 is a greatly magnified cross-sectional fragmentary view of a portion of the section of FIG. 4.

In FIGS. 1 to 3, the reference numeral 10 designates generally a fingernail file according to this invention, having an elongated body portion 11 with a bluntly pointed free end 12 and a plastic cap or head 13 embracing the end thereof opposite the pointed end 12. The body 11 is composed of a mild steel finger strip 14 with broad flat opposite faces **14*a* and 14*b* and thin end edges 14*c* and 14*d*. The finger strip 14 diverges from the blunt end 12 and is preferably slightly tapered to have a wide end 15 encased in the plastic head 13. The exposed length of the strip 14 along the wide flat faces 14*a* and 14*b* and along the end edges 14*c* and 14*d* thereof, is covered with a multiple layer coating 16 shown in FIG. 4 composed of a base layer 17 of resin material and sharp abrasive granules 18 and a plurality of layers 19, 20 and 21 of electro-deposited metal where the layer 19 may be a strike coating of copper, the layer 20 may be an electroplated layer of nickel, and the layer 21 may be an electroplated layer of chromium as shown in FIGS. 4 and 5. The granules 18 on one face 14*a* of the metal strip 14 may be coarser than the granules 18 on the other face 14*b* of the strip 14, and all of the coatings also cover the thin end edges 14*c* and 14*d* of the strip 14 thus forming a sheath or envelope around the body 11 as shown in FIG. 2**.

A thin electroless deposited coating of nickel 20*a* may be initially formed on the base resin layer 17 to underlie the copper strike coating forming a metal carrier for electroplating the copper thereover. This electroless nickel deposition avoids spotty copper plating and creates a better bond between the copper and resin.

The plastic material head or handle 13 can be composed of any suitable moldable inorganic plastics material, such as nylon, a phenolic base resin, an acrylic resin, or an epoxy resin, and the head may be directly molded around the end 15 of the metal strip or this end 15 may be bonded in a slot in the head 13.

The metal coatings 19, 20 and 21 form a sheath or shell around the resin coating 17 containing the abrasive particles 18, and these particles have sharp peaks projecting from the coating 17 as shown in FIG. 5, which are only thinly covered by the electroplated coating as illustrated at 22 with the valleys of the coating being relatively thick, as illustrated at 23, so that the sheath will firmly anchor the granules while the peaks of the granules projecting from the valleys 23 are almost exposed, being only thinly covered at 22. The thin covers 22 are relatively fragile and will break off as shown in dotted lines, exposing the sharp corners or peaks of the granules to the surface that is to be abraded.

Figure 6A:
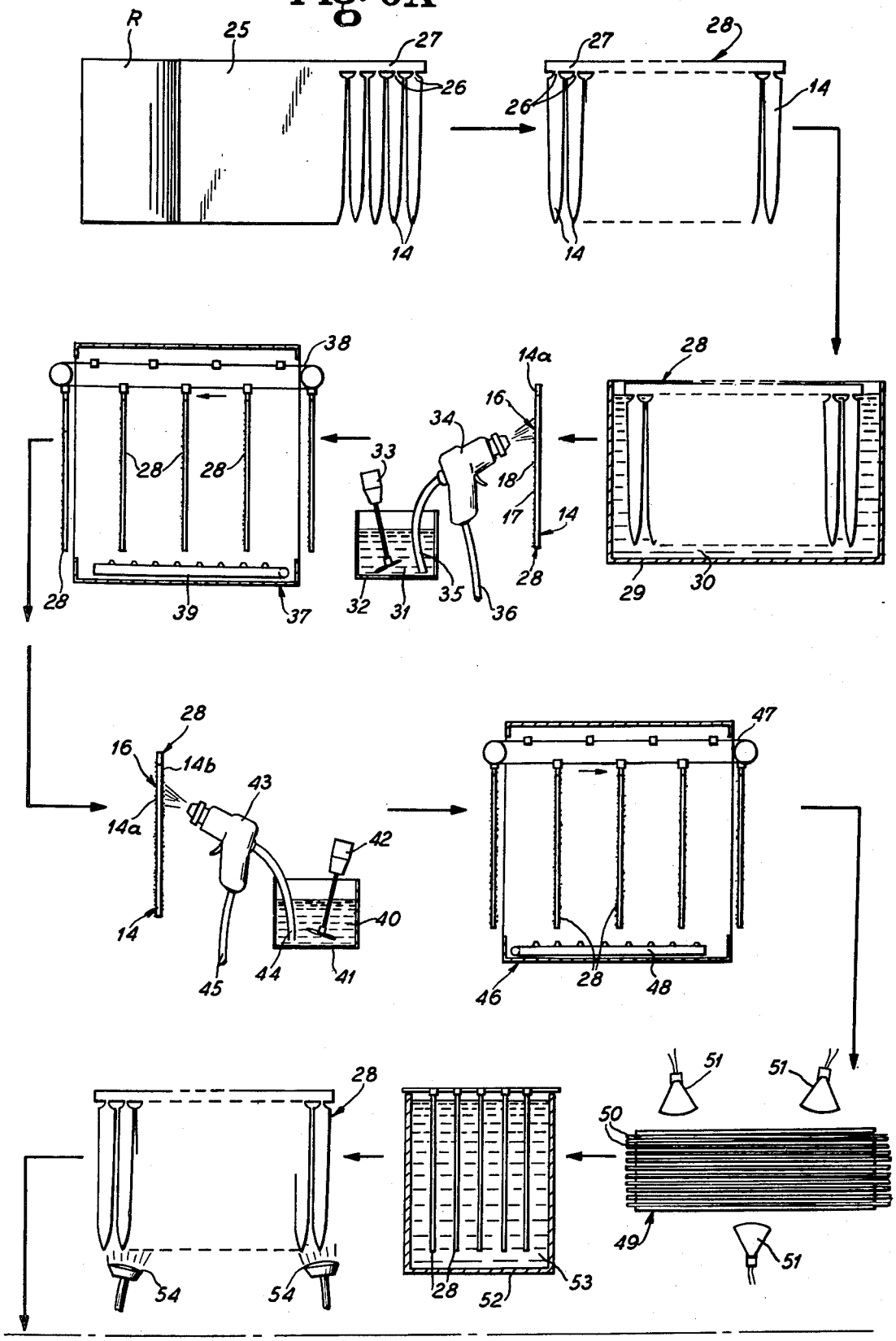
FIGS. 6A and 6B are diagrammatic flow sheets illustrating the steps in the method of manufacturing the nail files of this invention.
Figure 6B:
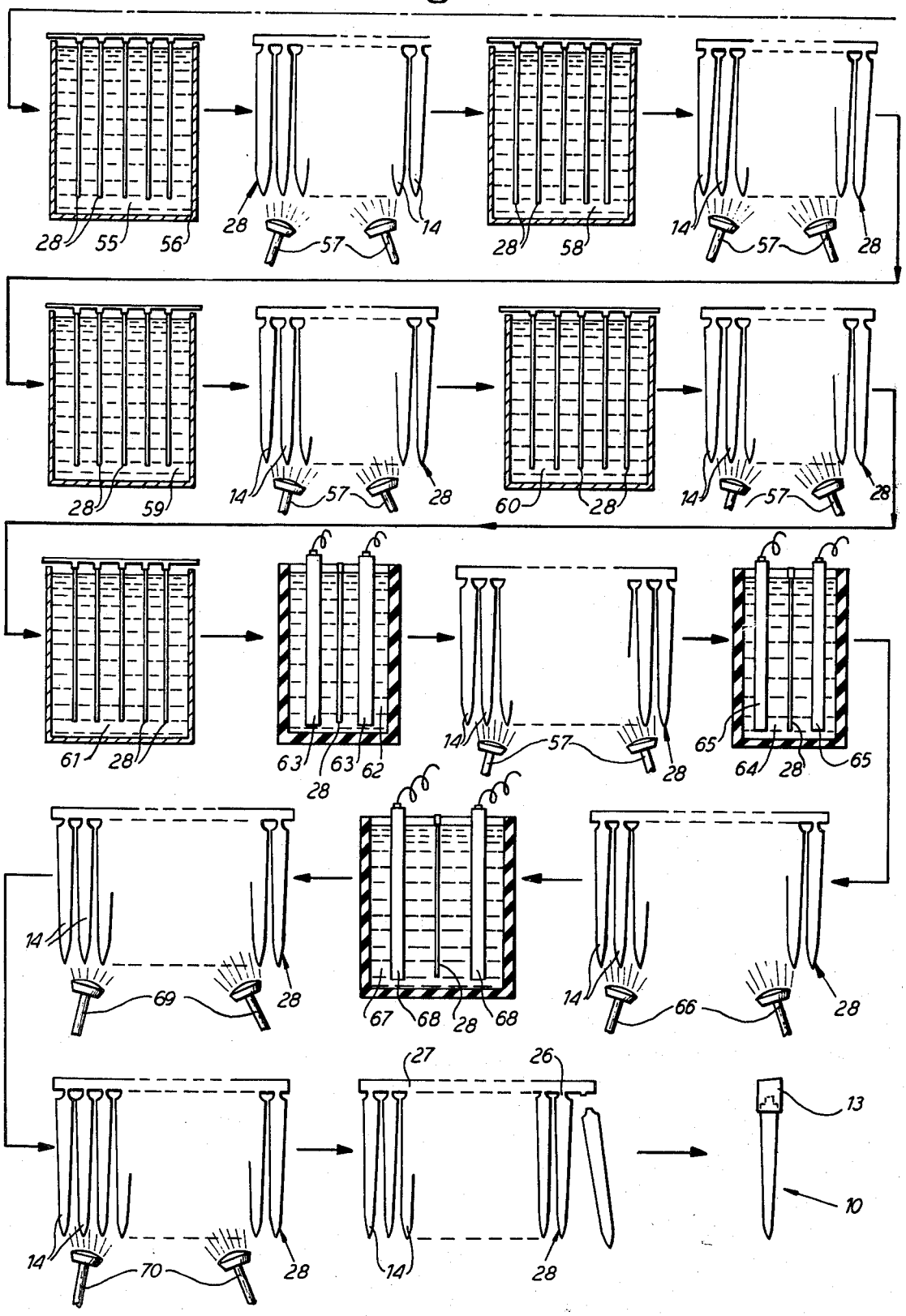

The production of the fingernail files 10 of this invention is diagrammatically illustrated in FIGS. 6A and 6B, wherein the successive steps follow in the sequence shown by the arrows. As shown in FIG. 6A, a strip 25 of mild steel such as SAE 1010 is unreeled from a roll R and successively stamped to form the fingers 14 suspended through thin connecting nibs 26 to a header 27. This header 27 is sequentially severed from the main strip 25 to provide a blank 28 with a number of fingers 14 depending therefrom that can be varied as desired for convenience in handling. Blanks 28 of 40 to 50 fingers 14, about 5 inches in length, and tapering from about $\frac{3}{8}$ to about $\frac{1}{4}$ inch in width, are useful but any desired file size is operative. The strip need only be about 1/32 inch thick.

The blanks 28 are immersed in a tank 29 filled with a commercial type washing solution 30 to strip off oil and grease and to clean the fingers 14 for a coating operation. The solution 30 may be iron phosphate dissolved in water at a concentration of about 3% by weight. The washing and stripping step may be carried out at room temperatures.

After the washing step in the tank 29, each blank 28 is advanced to a spray booth where each finger 14 receives the coating 16 composed of the resin 17 and the granules 18. As illustrated, a slurry 31 of the resin and granules is maintained in a mixing tank 32 which is continuously agitated by a stirrer 33 to provide a uniform suspension of the granules in the resin. The slurry is fed to a spray gun 34 through a tube 35, and the spray gun is actuated with compressed air from a hose 36. The face 14*a* of each finger 14 is coated to a desired depth by swinging the spray gun to eject the slurry for forming the uniform coating on the faces 14*a*. The coating of the end edges 14*c* and 14*d* also occurs. The granules 18 in the slurry 31 are relatively coarse and are very irregular in shape to present a number of pointed peaks and corners.

The granules 18 are preferably aluminum oxide ($Al_2O_3$) but other sharp, jagged refractory granules having good abrading action on a surface, such as silicon carbide, nickel oxide, tungston carbide and the like are useful. The granules may vary in size from, say, 120 to 320 mesh. Suitable grit size combinations for coarse and fine sides of fingernail files include 320 on one side and 280 on the other side, or 280 on one side and 240 on the other side, or 240 on one side and 120 on the other side.

A short chain epoxy ester or epoxide resin soluble in a hydrocarbon solvent of any known commercial type capable of skin curing is suitable. Suitable epoxides have been furnished by Emerson and Cuming Inc. of Canton, Mass. particularly their "Echo coat" LN 78122. A generally suitable epoxide has the following general structure:

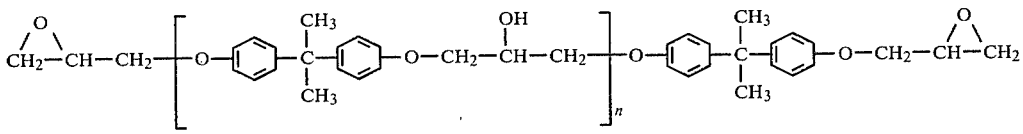

where n is less than 1 to provide a liquid.

A preferred slurry for forming the coating on the base metal strip is:

6 pounds aluminum oxide;

20–24 ounces xylene or methylethylketone;

1 gallon Emerson-Cuming epoxide resin solution LN78122 composed of 80% epoxy resin of the above type, 18% melamine, 1% bentone as a stabilizer and 1% pigment such as titanium-all percentages by weight.

Slurries with the above formulation are relatively thin and the spray coated slurry tends to have the epoxide flow to the strip surface. The slurry must be vigorously agitated in the tank 31 to maintain a good suspension of the granules in the vehicle.

A preferred spray technique is one pass over the blank 28 in a flat horizontal position in each of four right-angled directions with a concentration such that one gallon of the formulation will cover about 500 square feet.

Following the spray coating, the coated blanks 28 are passed through a heating tunnel 37, conveniently, while suspended on a conveyor belt 38. The tunnel 37 is heated, for example, by a burner head 39 to temperatures of about 375° F. and the coatings are heated, in the tunnel, for about 15 minutes to effect a skin cure.

Next, as shown in FIG. 6A, each blank 28 from the drying oven 37 with the skin dried coating 16 on one face thereof is subjected in a flat horizontal position to a second spray coating operation for spray coating the epoxy resin formulation on the other side or face 14*b* of the blank. For this purpose, a slurry 40 in a tank 41 continuously agitated by a stirrer 42 is fed to a second spray gun 43 through a tube 44 with the gun being activated from an air hose 45. The slurry 40 may have the same formula as described above for the first spray coating operation with the particles being somewhat finer mesh to provide a finishing or fine abrading action.

The freshly spray-coated blanks 28 are skin dried by passing through a heating tunnel 46 on a conveyor belt 47. The tunnel is heated from a burner head 48. The drying operation is the same as described above for skin drying the epoxy coating.

Next, the coated blanks 28 with skin cured coatings on both faces thereof are formed into a stack 49 with the individual blanks separated by clean paper sheets 50. The stack is heated by heat lamps 51 to temperatures of about 175° F. for about 20 to 24 hours for final cure of the epoxide. The heat lamps may be omitted, and the stacked coated blanks may be cured at ambient temperatures for about 72 hours.

Following the curing operation, the blanks 28 are suspended in a cleaning tank 52 containing a cleaning solution 53 of a commercially known resin cleaner, such as 10% aqueous solution of sodium hydroxide. A particular suitable cleaner of this type is "Nutra Clean" furnished by Shipley Company of Bristol, Conn.

Cleaning treatment in the solution 53 is then followed by a cold water rinse where the blanks 28 may be sprayed from spray heads 54.

As shown in FIG. 6B, the rinsed blanks are next immersed in another cleaning solution 55 in a tank 56 for about 2 minutes at room temperature. The solution 55 may be a 25% aqueous solution of sodium hydroxide containing 2% sodium lauryl sulfate (percentages by weight). These cleaning solutions are especially useful to clean the aluminum oxide grits. A suitable commercial solution is Shipley Company's 1110A.

A cold water rinse again follows the treatment with the cleaning solution 55 and as shown, spray heads 57 are useful to rinse the cleaned blanks 28.

Next, the blanks 28 are immersed in an etching solution 58 for 2 to 3 minutes at 160° F. The solution 58 is composed of 10% aqueous sulfuric acid, 40% of a 1% aqueous solution of palladium chloride solution (0.4% palladium chloride), balance water by weight.

Next the etched blanks 28 are rinsed with cold water from spray heads like 57 and after this, the rinsed blanks 28 are immersed in a stannous chloride accelerator bath 59 of the type shown in U.S. Pat. No. 3,011,920 at col. 5, line 28 for about two minutes at room temperature. This is followed by another cold water rinse with spray heads 57.

The etched accelerator rinsed blanks then receive an electroless nickel coating 20*a* of about 0.00001 to 0.00002 inches thick by immersing them in a bath 60 containing a nickel salt "Udylite" at about 72° F. A 2 minute immersion is ample. The solution should contain a nickel salt, a hypophosphate salt, water, a complexing agent, and a buffer. A suitable bath of the alkaline type is

| CONSTITUENT | GRAMS/LITER |
|---|---|
| Nickel sulfate | 30–45 |
| Sodium Hypophosphite | 10–11 |
| Citric Acid | 5 |
| Ammonium Hydroxide | to pH 7–8 |

Commercially, such formulae can be made from a water bath containing 3.5% each of "Udylite" nickel salt solutions Nos. 893 and 894 and 6% "Udylite" solution 892 furnished by Udylite Company of Warren, Mich. The nickel coat forms a base for the subsequent copper strike coat.

The nickel coated blanks 28 are again cold water rinsed from spray heads 57 and dipped in a 10% aqueous sulfuric acid bath 61 at room temperature.

Next the blanks 28 are electroplated in a copper plating bath 62 to receive the copper strike coating 19 over the electroless nickel coating 20*a*. This copper strike may also be quite thin in the order of 0.00003/0.00005 inches. Standard copper plating techniques from copper anodes 63 are useful. The plating bath may contain 32 ounces of copper sulfate in 650 gallons of water and 26 gallons of sulfuric acid (66° Be). Plating with 3 volts for 1½ minutes is sufficient.

Following the copper strike plating, the blanks 28 are again rinsed with water from spray heads 57 and then subjected to a nickel plating bath 64 for 3 minutes at 3 volts where they are electroplated from nickel anodes 65 to form the nickel plate layer 20 over the copper strike 19. Standard nickel plating techniques are useful to produce coatings of about 0.00009/0.00012 inches. The nickel plating bath may contain 34 ounces of nickel sulfate, 18 ounces of nickel fluoride, 8 ounces of boric acid and 1300 gallons of water.

Next, the nickel plated blanks are spray rinsed from spray heads 66. Cold water sprays are useful.

The nickel plated blanks 28 are then chromium plated in a bath 67 from chromium anodes 68 to form the coating 21 over the nickel coating 20. Standard chrome plate techniques can be used.

Plating is carried out at 5 volts for 1½ minutes. The bath may comprise 32 ounces chromic acid in 450 gallons water. The thickness of the chrome layer is only about 0.000010/0.000020 inches.

Following the chrome plating operation, the blanks 28 are subjected to a cold water rinse 69 and a hot water rinse 70 at about 120°–140° F.

The file fingers 14 of the blanks are then broken off from the connecting strip 27, and the heads or handles 13 are applied as described above.

It will be noted from FIG. 5 that the peaks of the particles or granules 18 are either exposed or very thinly covered. It will be noted that the electroplated layers 19, 20 and 21 are thicker in the valleys 23 than at the peaks 22, and a sheath, shell or crust of the electroplated metal thus surrounds the resin coating 16 to firmly anchor the particles 18. The peak coverings may only be on the order of 0.00001 inches, while the valley coverings may be about 0.00002 inches.

From the above descriptions, it will be understood that this invention provides abrasive devices where the abrasive particles are initially anchored on a structural base with a resin and are then firmly and permanently anchored in one or more metal layers surrounding the resin material and forming an envelope, or sheath with only very thin portions covering the peaks of the particles so that the particles are exposed during use and thick portions in the valleys providing secure anchors for the particles.

It will be apparent that many modifications and variations could be effected by one skilled in the art without departing from the spirit and scope of the novel concepts of the present invention, so that the scope of the invention should be determined by the appended claims only.

I claim as my invention:

1. An abrasive device comprising a structural base, a coating of abrasive particle containing resin material on the base, and a sheath of plated metal overlying the resin coating and having thin frangible portions covering the peaks of the particles which are broken off during abrasion to expose the particles.

2. A fingernail file comprising a thin metal finger having wide opposite faces, a first coating of resin and coarse abrasive grits on one face of the finger, a second coating of resin and fine abrasive grits on the opposite face of the finger, and a thin envelope of plated metal overlying the coatings and having only thin frangible portions covering grits projecting from the coatings and thick portions firmly anchoring the main body portions of the grits.

3. A file comprising a metal strip, a slurry of abrasive granules and resin coated on the strip and a crust of electrodeposited metal covering the resin coating and anchoring the granules.

4. The device of claim 1 wherein the base is steel and the granules are aluminum oxide.

5. The device of claim 1 wherein the resin is an epoxide.

6. The device of claim 1 wherein the plated metal includes superimposed layers of different metals.

7. The device of claim 6 wherein the different metal layers include copper, nickel and chromium.

8. The file of claim 2 wherein the plated metal includes a strike coating of copper.

9. The file of claim 2 wherein the plated metal includes a plurality of layers of different metal.

10. The file of claim 3 wherein the resin is an epoxide.

11. The file of claim 3 wherein the crust has a plurality of layers of different metals.

12. In an abrasive device, a base having a surface coated with a slurry of abrasive granules and cured plastics material resin with the resin constituent settled on the base exposing peaks of the granules and said peaks being etched free from said resin.

13. The abrasive device of claim 12 including a crust of electro-deposited metal covering the coating and anchoring the granules.

14. An article with a friction surface which comprises a metal base, a sheath of abrasive particle containing resin material surrounding and anchored on the base, and a plurality of sheaths overlying the resin material sheath composed of plated metal having thin frangible peaks overlying the peaks of the granules which are broken off to expose the granule peaks during use of the article.

15. The article of claim 1 wherein the sheath of plated metal includes a bottom layer of non-electroplated metal on the resin coating.

16. The file of claim 1 or 2 wherein the envelope or crust includes a layer of electroless deposited metal directly on the resin coating.

17. The article of claim 14 wherein the plated metal sheaths include a bottom sheath of non-electroplated metal directly on the resin material sheath.

18. The device of claim 15 wherein the non-electroplated metal is nickel.

19. The file of claim 16 wherein the electroless deposited metal is nickel.

20. The article of claim 17 wherein the non-electroplated metal is nickel.

* * * * *